US006764214B2

(12) United States Patent
Shukla et al.

(10) Patent No.: US 6,764,214 B2
(45) Date of Patent: Jul. 20, 2004

(54) FLEXIBLE ARM SHAKER

(76) Inventors: Ashok Kumar Shukla, 10316 Kingsway Ct., Ellicott City, MD (US) 21042; Mukta Misra Shukla, 10316 Kingsway Ct., Ellicott City, MD (US) 21042; Amita Misra Shukla, 10316 Kingsway Ct., Ellicott City, MD (US) 21042

( * ) Notice: Subject to any disclaimer, the term of this patent is extended or adjusted under 35 U.S.C. 154(b) by 268 days.

(21) Appl. No.: 09/984,687

(22) Filed: Oct. 31, 2001

(65) Prior Publication Data

US 2003/0081494 A1 May 1, 2003

(51) Int. Cl.[7] ..... B01F 11/00
(52) U.S. Cl. ..... 366/214; 366/209
(58) Field of Search ..... 366/210, 211, 366/213, 214, 110, 117, 118, 208, 209, 215, 216, 602, 607

(56) References Cited

U.S. PATENT DOCUMENTS 1,898,094 A * 2/1933 Nies ..... 366/602
2,286,600 A * 6/1942 Chott ..... 366/602
2,532,238 A * 11/1950 Malke ..... 366/607
3,384,354 A * 5/1968 Migule et al. ..... 366/118
3,498,533 A * 3/1970 Schomburg ..... 494/41
3,814,387 A * 6/1974 Ahrens et al. ..... 366/602
3,993,290 A * 11/1976 Kovich ..... 366/130
4,623,470 A * 11/1986 Adler ..... 494/11
5,571,283 A * 11/1996 Vollgold ..... 366/143
5,577,837 A * 11/1996 Martin et al. ..... 366/145

FOREIGN PATENT DOCUMENTS

EP 428395 A1 * 5/1991

OTHER PUBLICATIONS

LOC–Line: The Original Modular Hose System Brochure, Lockwood Products, Inc., Aug. 1994.*

* cited by examiner

*Primary Examiner*—Charles E. Cooley

(57) ABSTRACT

In this invention we describe a shaking device that is used to shake, stir, mix, rotate or agitate samples in containers attached to the shaking device. The shaking device, herein referred to as the shaker, is used to mix the solid, liquid or gaseous components of the sample in the container. The shaker described in this invention has a flexible arm to which the containers containing samples are attached. Due to the flexibility of the arm, its shape can be changed such that the speed and type of sample shaking can be varied based on the shape of the arm and based on where on the arm a sample container is attached. In this manner, orbital, linear, circular and other two or three-dimensional shaking, mixing, agitation and stirring of the sample can be achieved. The present invention provides an easy new method for shaking samples in containers of different shapes and volumes, at different speeds and in different orientations in space.

4 Claims, 5 Drawing Sheets

FLEXIBLE ARM SHAKER

FIELD OF THE INVENTION

In this invention we describe a shaking device that is used to shake, stir, mix, rotate or agitate samples in containers attached to the shaking device. The shaking device, herein referred to as the shaker, is used to mix the liquid or solid components of the sample in the container. The shaker described in this invention has a flexible arm to which the containers containing samples are attached. The flexible arm can be made of interlocking segments. Due to the flexibility of the arm, its shape can be changed such that the speed and type of sample shaking can be varied based on the shape of the arm and based on the position of the sample container on the arm. In this manner, orbital, linear, circular and other two or three-dimensional shaking, mixing, agitation and stirring of the sample can be achieved. The present invention provides an easy new method for shaking samples in containers of different shapes and sizes, at different speeds and in different orientations in space.

BACKGROUND OF THE INVENTION

In chemical, biological and biochemical laboratories, many different sample preparation methods require that a sample be shaken, mixed, stirred or agitated for the uniform mixing of the components of the sample. Currently, a number of different stirring and shaking devices are commercially available in the market. Some of these shaking devices consist of a level surface which rocks back and forth at a specified angle or which rotates in different directions for the shaking of samples in petri-dishes, flasks and other containers which can be placed on the level surface. Alternatively, other shaking devices consist of rotation devices in which containers such as test tubes or vials can be placed and rotated up to 360 degrees for the mixing of the sample.

While the currently available devices provide fixed rotation angles and speeds, the flexible arm shaking device invention described herein, can shake or rotate sample containers at different speeds and in different two or three-dimensional rotations due to the flexible arm to which the sample containers are attached. The shaking device described in the present invention, also referred to as a shaker, is used to shake, agitate, rotate, stir or mix samples in containers attached to said shaker. Thus, in this invention some samples can be shaken gently and others more vigorously depending on where along the arm of the shaker the sample containers are attached. The shape of the arm can be kept rigid and linear or it can be bent into different shapes such as circular or wave-from shapes. These different shapes and orientations of the arm allow different sample containers to rotate at varying speeds and in different orientations. Furthermore, unlike other shaking devices currently available on the market, the present invention provides many different shaking options within the same shaking device, as well as, various options for attaching sample containers to the flexible arm of the shaker or rotator. Furthermore, in the present invention on or more flexible arms can be attached to each other or to the rotating device. These arms can be present in any form such as linear or branched and they provide even further options for rotation speeds and orientations for sample containers.

Often sample shaking or rotation need to be performed at specific temperatures such as in an oven or under certain conditions such as in a water bath. With currently available methods, the entire shaking unit needs to be placed in the oven or water bath and thus often needs to be designed to withstand heat or moisture. This poses hazard dangers such as the potential for electric shocks resulting from placing an electric shaking device in a water bath. The shaker described in the present invention can be designed such that only the flexible arm of the shaker is placed in an oven or a water bath and the electrical components of the shaking device are present on the exterior of the oven or water bath.

In the present invention, the flexible arm of the shaker can be attached to a motor or any other shaking, vibrating or rotating device that moves the flexible arm in a desired orientation and at desired speeds. The motor, or similar device can be powered by any mechanical, electrical, electrochemical, battery-based or other methods. The flexible arm can be made of metal, plastic or of inter-locking plastic segments (known brand name LOC-LINE™ from Lockwood Products, Inc.) and similar plastic segments, which are available from different manufacturers and give the same effect. The arm made of these segments can be twisted in any direction, axis or shape. These interlocking segments are used to transport the cooling fluid in the lathe or milling machines. Furthermore, by using branching segments a multiple rotation can be achieved.

SUMMARY OF THE INVENTION

The present invention consists of a shaker that has a flexible arm that can be twisted or bent into different shapes at different angles. The present invention is used to shake, stir, rotate, agitate or mix the different components of a sample placed in a container attached to the flexible arm of said shaker. The sample containers can be attached to the shaker by any methods such as magnets, clasps, sockets and clamps. The flexible arm of the present invention can furthermore be attached to a rotating or shaking device such as a motor or any other device suitable for shaking, rotating, mixing or agitating the sample. The different positions of the flexible arm allow for the shaking of samples at different speeds and at different orientations based on the position of the given sample container on said shaker.

Furthermore, a specific shaking device such as a motor can be attached to the arm to provide different speeds at which the flexible arm can be rotated. In addition, the flexible arm of the present invention can be used to expose samples in sample containers to heat, such as in an oven, or to conditions such as constant temperature in a water bath, without exposing the electric or other components of the shaker to heat, water or other potentially hazardous conditions.

The various features of novelty, which characterize the present invention, are pointed out with particularity in the claims annexed to and forming a part of this disclosure. For a better understanding of the invention, its advantages and objects, reference is made to the accompanying drawings and descriptive matter in which a preferred embodiment of the invention is illustrated.

BRIEF DESCRIPTION OF THE DRAWINGS

The foregoing and still other objects of this invention will become apparent, along with various advantages and features of novelty residing in the present embodiments, from study of the following drawings, in which.

DESCRIPTION OF THE PREFERRED EMBODIMENTS

Figure 1:
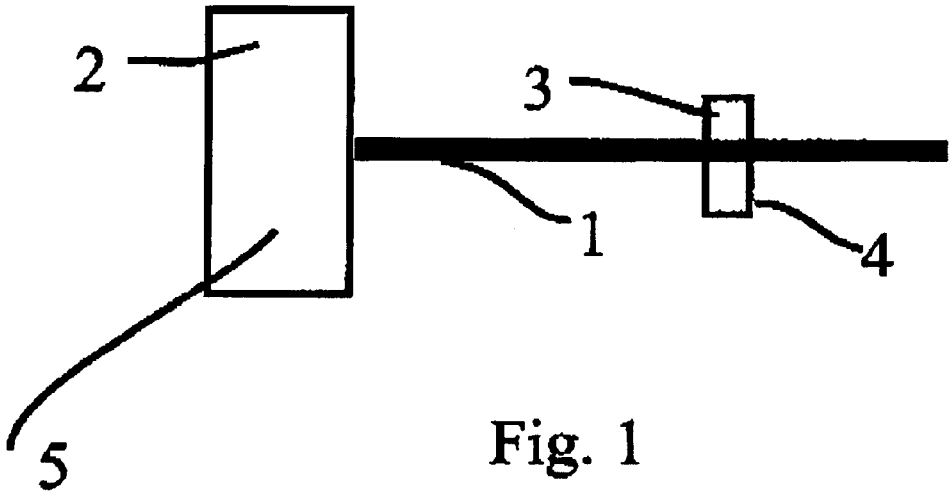
FIG. 1 is an expanded view of one embodiment of a shaker, according to the present invention, wherein the flexible arm is in a straight position, relative to the axis of rotation, and attached to a rotation device.

FIG. 1 shows one embodiment of a shaker, according to the present invention, wherein the flexible arm (1) is in a straight position, and attached to a rotating device (2). Also, as shown in FIG. 1, a container (3) containing a sample (4) is attached to said flexible arm (1). The shaking device shown in FIG. 1, shakes said sample (4) in said container (3) by a method selected from the group consisting of mixing, stirring, agitating, rotating, rocking and combinations thereof. The sample (4) in said container (3) can consist of any type of sample including, but not limited to, a sample selected from the group consisting of a solid sample, a liquid sample, a gaseous sample, and combinations thereof.

While FIG. 1 shows a rotating device (2) that represents a simple motor, said rotating device can be any type of device suited for rotating or moving the flexible arm (1) including, but not limited to a rotating device selected from the group consisting of a motor, a rotator, an agitator, a vibrator, a stirrer, and combinations thereof. FIG. 1 shows the flexible arm (1) attached to a rotating device that is powered through an electric cord (5). At the same time, said flexible arm can be free-standing without attachment to any other devices. The rotating device (2) can be powered by any means selected from the group consisting of mechanically powered means, electrically powered means, chemically powered means, pressure based means, vacuum based means, battery powered means, and combinations thereof. Furthermore, while FIG. 1 shows the rotating device (2) attached to the flexible arm (1) at one end of said arm, said rotating device (2) can be attached to said flexible arm of said shaking device anywhere along the length of said flexible arm. Furthermore, the arm (1) can also be attached to an axis or similar device that, in turn, is attached to and rotated by the rotating device (2). Furthermore, when the rotating device (2) is a motor, a shaking effect can be achieved by changing the electrical poles of the motor. The extent of rotation will depend on the rotation speed of the motor and the axis of rotation.

Figure 2:
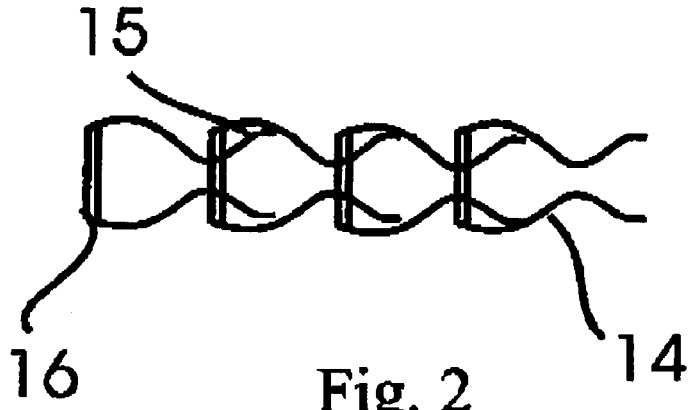
FIG. 2 is an expanded view of one embodiment of a shaker, according to the present invention, wherein the flexible arm is positioned at an angle, relative to the axis of rotation, and attached to a rotation device.

In FIG. 2 flexible arm (1) can be made of metal, plastic or combination of both. The metal wire can also be used as the flexible arm. The flexible arm can be made of interlocking elements (14) or segments, by joining them together. Each interlocking segment (14) includes a ball and socket arrangement. Each segment includes a ball portion (15) and a socket portion (16). The segments are connected together in series with a ball portion (15) inserted into the socket portion (16) of an adjacent segment. Any desired quantity of segments (14) can be placed together to form the flexible arm (1). The preferred segments are plastic segments known as LOC-LINE™ from Lockwood Products, Inc. The segments are mostly made of acetal plastic or any other polymers. The interlocking elements are hollow inside to allow the flow of fluids. However, for shaking application the interlocking elements can be hollow or solid. Furthermore, interlocking elements can be made of magnetic material or a combination of magnetic material and plastic. The advantage of using a magnetic material is that steel sample containers can be directly attached to the arm.

Figure 3:
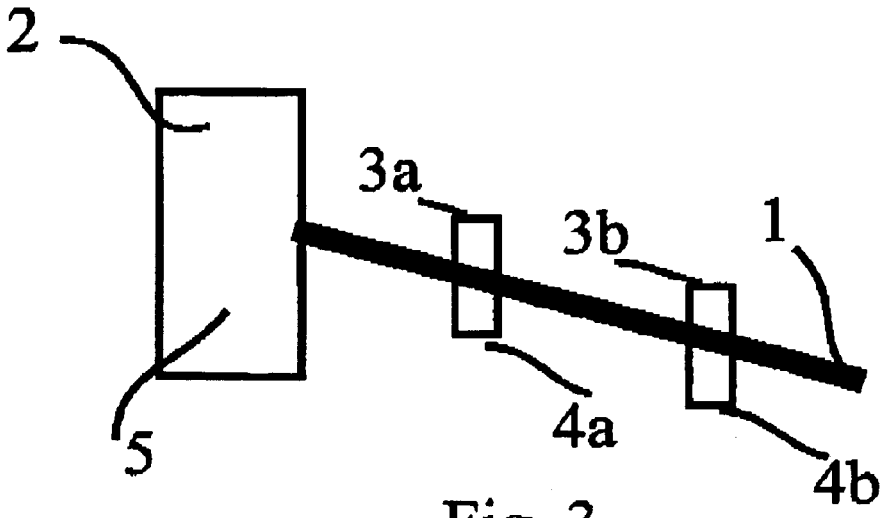
FIG. 3 is an expanded view of one embodiment of a shaker, according to the present invention, wherein the flexible arm is in a waveform shape, and attached to a rotation device.

FIG. 3 shows a shaker, according to the present invention, wherein the flexible arm (1) is positioned at an angle, relative to the axis of rotation (6), and attached to a rotation device (2). In this figure two containers **(3*a* and 3*b*) are attached to the flexible arm (1). The axis of rotation (6) indicates the line around which the flexible arm (1) rotates. As can be seen in FIG. 3, container (3*a*) is significantly farther from the axis (6) than container (3*b*). Thus, when a rotating device (2) is used to rotate the arm (1) container (3*a*) will be rotated more vigorously than container (3*b*) such that the sample (4*a*) in container (3*a*) is agitated more vigorously than the sample (4*b*) in container (3*b*)**.

Figure 4:
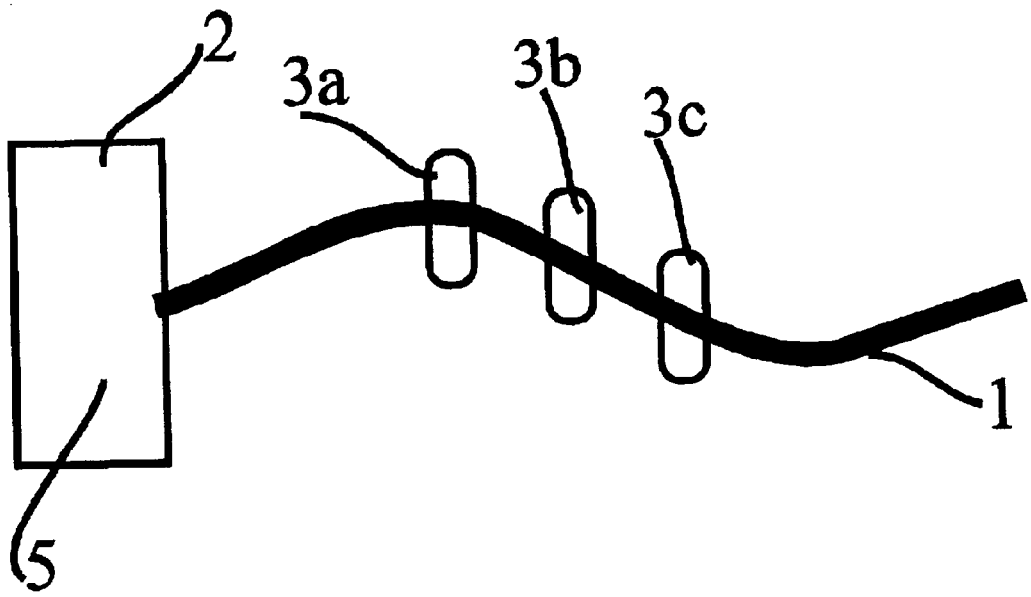
FIG. 4 is an expanded view of one embodiment of a shaker, according to the present invention, wherein the flexible arm is in a circular shape, and attached to a rotation device.
Figure 5:
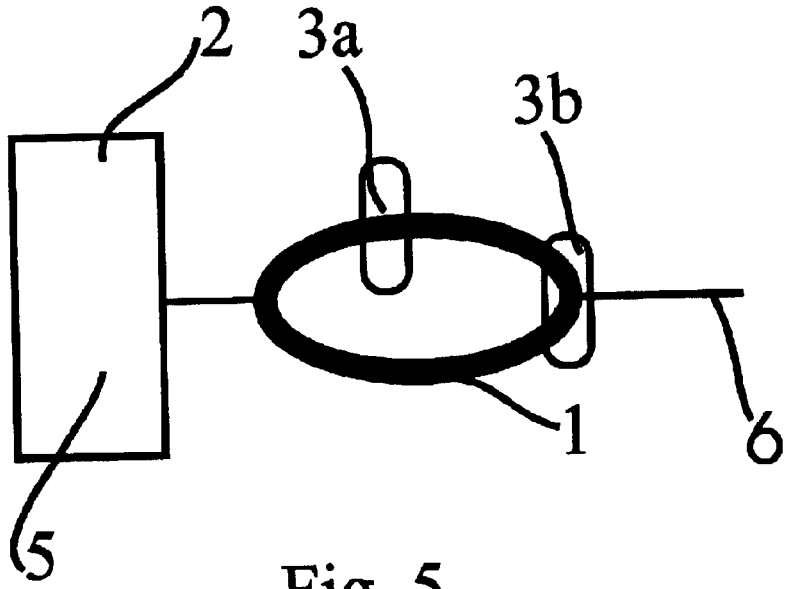
FIG. 5 is an expanded view of one embodiment of a shaker, according to the present invention, wherein the flexible arm is in a waveform shape, attached to a rotation device at one end and attached to a support at the other end.

FIG. 4 shows the flexible arm (1) in a waveform shape. In this instance, container **(3*a*) is farthest from the axis of rotation (6), container (3*b*) is closer to the axis (6) and container (3*c*) is closest to the axis (6). In this configuration the samples (4*a*, 4*b*, 4*c*) in each of the containers will be shaken at different rates such that sample (4*a*) is shaken most vigorously, sample (4*b*) is shaken less vigorously, and sample 4(*c*) is shaken least vigorously. FIG. 5 shows the flexible arm of the present invention in a circular shape. In this instance, container (3*a*) is farthest from the axis of rotation (6) and container (3*b*) is closest to the axis (6)** again providing variation in the rotation rates and positions of each of those containers.

As shown in FIGS. 1–5, the flexible arm (1) can be twisted into any shape including but not limited to those selected from the group consisting of a straight line, a circular shape, a waveform shape, a square shape, an irregular shape, an oval shape, a zig-zag shape, a t shape, a branched shape, and combinations thereof.

The flexible arm (1) described in the present invention can be made of any materials including, but not limited to, a material selected from the group consisting of plastic, synthetic polymers, natural polymers, TEFLON™ (polytetrafluoroethylene. PTFE). glass, metal, wood, ceramic and combinations thereof. Furthermore, the flexible arm (1) can be made of interlocking segments of the same material or of interlocking segments of different types of materials. The interlocking can be achieved by different methods such as when two segments are joined together by pressure applied to interlocking parts of each of the segments. These interlocking parts are stable and flexible such that the arm (1) can be bent into different shapes. Such an interlocking structure can also support the weight of containers (3) containing samples (4), depending on the weight of the container (3) and sample (4) and the strength of the material used. Alternately any other bendable or malleable material can be used to create said flexible arm (1).

Figure 6:
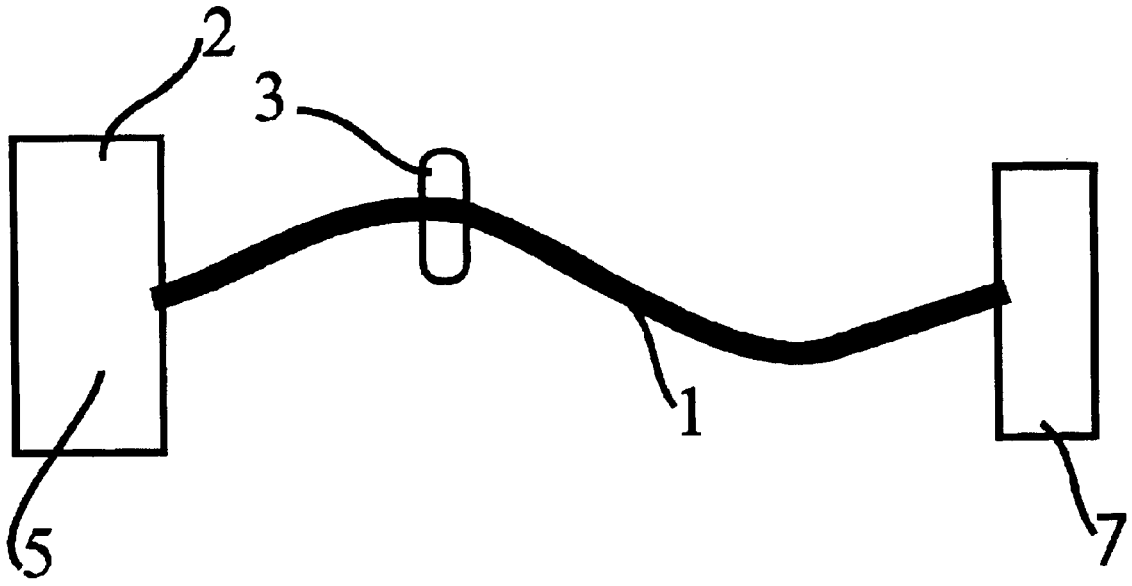
FIG. 6 is an expanded view of one embodiment of a shaker, according to the present invention, wherein a sample container is attached to the flexible arm by a magnet.

FIG. 6 shows the shaker, according to the present invention, wherein the flexible arm (1) is attached to a rotating device (2) at one end and attached to a support (7) at the other end. The support (7) to which the arm (1) is attached serves the purpose of stabilizing the movement of the arm (1) during rotations by the rotating device (2) and provides structural and functional support to the shaker described in the present invention.

Figure 7:
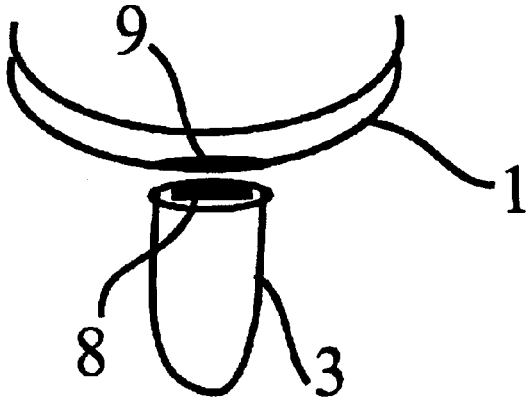
FIG. 7 is an expanded view of one embodiment of a shaker, according to the present invention, wherein a sample container is attached to the flexible arm by a clamp.
Figure 8:
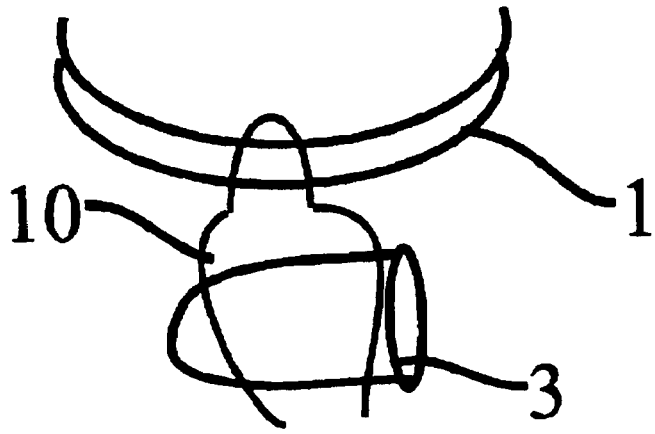
FIG. 8 is an expanded view of one embodiment of a shaker, according to the present invention, wherein a platform is attached to the flexible arm and a plate is placed on said platform.

The container (3) containing the sample (4) can be attached to the flexible arm (1) by a number of different methods, two of which are illustrated in FIGS. 7 and 8. In FIG. 7, the container (3) has a magnet (8) attached to it that is used to attach the container (3) to the flexible arm (1). If the flexible arm (1) consists of or contains a magnetic metal such as iron the magnet (8) can be directly attached to the arm (1). Alternately, as shown in FIG. 7, a magnet (9) can also be attached to the arm (1) by any means, to which the magnet (8) on the container (3) can be attached. The magnet (9) on the arm (1) can be present anywhere on the arm (1). If the arm (1) consists of a magnetic material, the arm (1) can be coated with an inert material. The magnet (8) on the sample container can be permanently or temporarily attached anywhere on the inside or outside surface of said container (3). This magnet (8) or magnetic material can also be coated with an inert material, so that it does not react with the sample (4) in the container (3).

FIG. 8 shows the container (3) attached to the flexible arm (1) by a clamp (10). In addition to the methods illustrated in FIGS. 7 and 8, the container (3) can be attached to said flexible arm (1) by any other temporary or permanent means or by a device including, but not limited to, a device selected from the group consisting of a magnet, a clamp, a clasp, a clip, a hook, a fastener, a socket, a rubber band, hook and loop fastener such as VELCRO™, glue, a polymer, a resin, and combinations thereof. Thus, the container (3) can either be removable from the arm (1) or be permanently attached to the arm (1).

Figure 9:
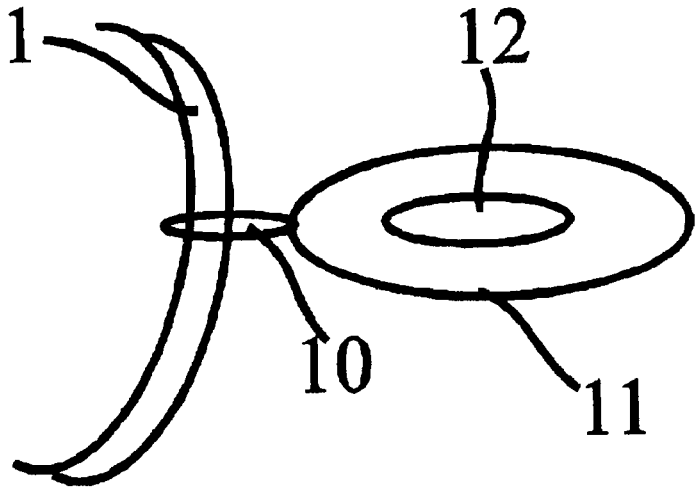
FIG. 9 is an expanded view of one embodiment of a shaker, according to the present invention, wherein said shaker contains multiple flexible arms in branch form.

FIG. 9 shows the shaker, according to the present invention, wherein a platform (11) is attached to the flexible arm (1) such that a plate (12) can be placed on said platform (11). This configuration of the present invention is useful for shaking samples in flat containers such as petri dishes, agar plates or for attaching tubes and other types of containers onto the surface of said platform (11). In the figure shown, the platform (11) is attached to the arm (1) by a clamp (10) although it can be attached to the arm (1) by any means or device including, but not limited to, a device selected from the group consisting of a magnet, a clamp, a clasp, a clip, a hook, a fastener, a socket, a rubber band, hook and loop fastener such as VELCRO™, glue, a polymer, a resin, and combinations thereof. Furthermore, the plate (12) can be attached to the platform (11) by any permanent or temporary means that ensure that the plate (12) stays attached to the platform (11) during the rotation process.

Figure 10:
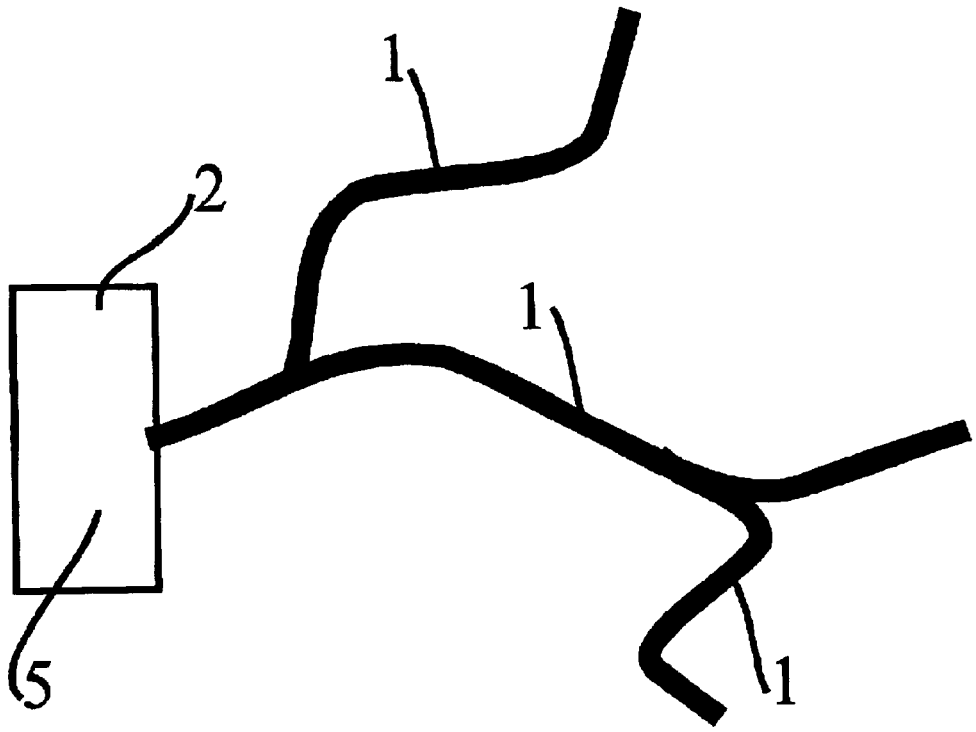
FIG. 10 is an expanded view of one embodiment of a shaker, according to the present invention, wherein said shaker contains multiple flexible arms attached to a rotation device.
Figure 11:
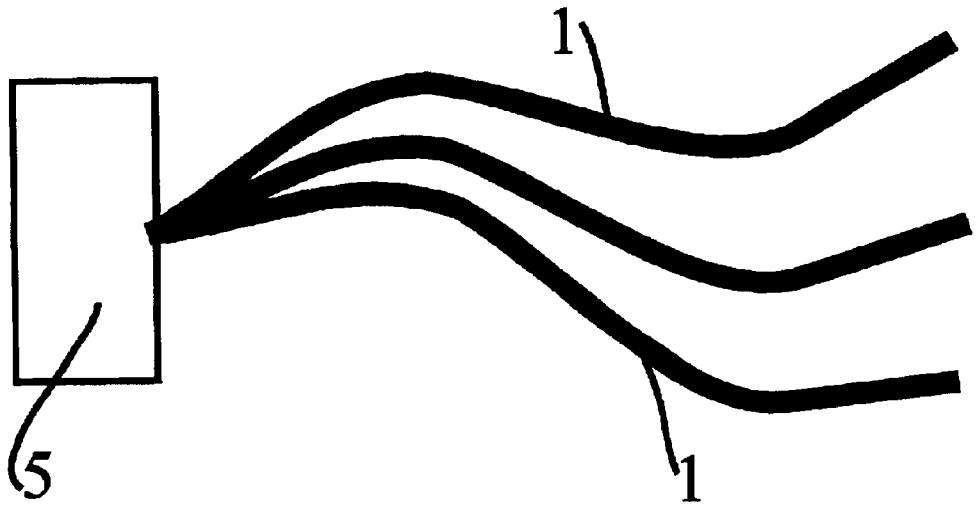
FIG. 11 is an expended view of one embodiment of flex arm made of interlocking segments or elements.

The flexible arm (1) described in the present invention can be of any shape and can be twisted into any shape selected from, but not limited to, the group consisting of a linear shape, a circular shape, a waveform shape, a square shape, an irregular shape, an oval shape, a zig-zag shape, a t shape, a branched shape, and combinations thereof. Furthermore, the arm (1) can have multiple branches, such as in a t-shape, and multiple arms can be attached to the rotating device. FIG. 10 shows a rotating device (2) attached to a flexible arm (1) from which other flexible arms (1) branch out. FIG. 11 shows multiple flexible arms (1) attached to a single rotating device (2). The configurations illustrated in FIGS. 10 and 11 can also be combined for to develop alternate configurations for the flexible arms of the shaking device described herein.

The shaking device described in this invention can be designed such that the arm (1) of said device can be placed in a chamber which maintains said container (3) at a constant temperature, such as in an oven or a water bath. Since the present invention is designed such that the arm (1) can be bent into desired shapes, the container (3) can be exposed to desired heat levels while the rotating device (2) and other components of the shaker are exterior to said oven, water bath, or any other temperature-controlled environment used for the container (3). Furthermore, the shaking device itself can contain a system for shaking said container (3) at a constant temperature. The flexible arm (1) of the present invention can be covered by a protective sleeve designed to protect said arm from factors such as dust, heat, moisture, chemicals, and combinations thereof. This sleeve can also be made of an inert material.

The broader usefulness of the invention may be illustrated by the following example.

EXAMPLE 1

Shaking of Microfuge Tubes

FIG. 4 shows three different ways in which containers (3*a*, 3*b*, 3*c*) such as microfuge tubes can be attached to the flexible arm (1) to shake the samples (4*a*, 4*b*, 4*c*) inside said containers. Microfuge tubes are commonly used in biological and biochemical labs. In applications where lipid and water-soluble substances are present in a tube, vigorous shaking is necessary to agitate and mix the lipid and water-soluble components of the sample. In this case, the microfuge tube would be placed at the position indicated by container (3*a*) in FIG. 4. Since this position is farthest from the axis of rotation (6) the sample will be shaken more there than at the position held by container (3*c*) which is closest to the axis of rotation (6) of the flexible arm (10). When enzymes and substrates are placed in a microfuge tube, very gentle shaking is needed to catalyze desired reactions. Thus, in this case, the microfuge tube would be placed at the position indicated by tube (3*c*) in FIG. 4.

As this example illustrates, the shaking device of the present invention can be used to shake different types of samples at different rates and in different orientations depending on their position along the flexible arm (1) of said shaking device. The present invention thus combines the tasks that would typically be performed by multiple shakers into a single device.

While a specific embodiment of the invention has been shown and described in detail to illustrate the application of the principles of the invention, it is understood that the invention may be embodied otherwise without departing from such principles and that various modifications, alternate constructions, and equivalents will occur to those skilled in the area given the benefit of this disclosure and the embodiment described herein, as defined by the appended claims.

What is claimed is:

1. A shaking device comprising a flexible arm of interlocking segments to which at least one container is removably attached, said interlocking segments each including a ball portion and a socket potion with said interlocking segments being connected together in series with a respective ball portion inserted into a corresponding socket portion of an adjacent segment, said flexible arm being attached to a rotating device for moving said flexible arm and shaking the contents of said removable container.

2. A shaking device as in claim 1, wherein said flexible arm is made of a material selected from the group consisting of plastic, synthetic polymers, natural polymers, metal, and polytetrafluoroethylene (PTFE), and combinations thereof.

3. A shaking device as in claim 1, wherein said container is removably attached to said flexible arm by a device selected from the group consisting of a magnet, a clamp, a clasp, a clip, a hook, a fastener, a socket, a rubber band, hook and loop fastener, glue, a polymer, a resin, and combination thereof.

4. A shaking device as in claim 1, wherein said flexible arm in said device is anchored to at least one support to obtain a stable configuration.

* * * * *